US006427615B1

(12) United States Patent
Ku

(10) Patent No.: US 6,427,615 B1
(45) Date of Patent: Aug. 6, 2002

(54) MODULARIZED UNMANNED MARINE SURFACE VEHICLE

(75) Inventor: Bih-Yuan Ku, Taipei (TW)

(73) Assignee: Strong Engineering Consulting Co., Ltd., Taipei (TW)

( * ) Notice: Subject to any disclaimer, the term of this patent is extended or adjusted under 35 U.S.C. 154(b) by 0 days.

(21) Appl. No.: 09/760,762

(22) Filed: Jan. 17, 2001

(51) Int. Cl.[7] ..... B63B 3/04
(52) U.S. Cl. ..... 114/77 R; 114/61.3; 114/61.31
(58) Field of Search ..... 114/77 R, 61.27, 114/61.29, 61.3, 61.31, 144 A

(56) References Cited

U.S. PATENT DOCUMENTS 3,078,938 A * 2/1963 Bollum, Sr. ..... 114/77 R
3,422,780 A * 1/1969 Becker, Jr. ..... 114/77 R
5,713,293 A * 2/1998 Shiffler ..... 114/56
5,995,882 A * 11/1999 Patterson ..... 701/21
6,269,763 B1 * 8/2001 Woodland ..... 114/382

* cited by examiner

*Primary Examiner*—Sherman Basinger
(74) *Attorney, Agent, or Firm*—Troxell Law Office PLLC

(57) ABSTRACT

A modularized unmanned marine surface vehicle contains control section and propulsion section. The control section is composed of bow section, control cabin, probing module, communication module and conjunction module. The propulsion section contains an energy cabin and a power plant cabin. The conjunction module can be combined with the energy cabin as a complete unmanned marine surface vehicle. The probing module contains probing instruments and equipment. The propulsion section can be battery-powered, gasoline-powered or diesel-powered. The propulsion section can be equipped with a propeller, a water jet or a turbine jet propeller of high power or low power as the power source assembly.

6 Claims, 3 Drawing Sheets

MODULARIZED UNMANNED MARINE SURFACE VEHICLE

BACKGROUND OF THE INVENTION

1. Field of the Invention

The above mentioned invention relates to an unmanned marine surface vehicle, with the capability of offering various optional measurement modules and a variety of power source assemblies.

2. Description of Related Art

While probing the depths, measuring water temperature, and assessing water quality in shallow waters, it is necessary to use a compact remote-controlled unmanned marine surface vehicle. Vehicles of this type are typically designed as a fixed structure: That is, a single vehicle that has a single set of measurement instruments and a single type of propulsion assembly. It has not in the past been easy to change the measurement module to meet the variety of purposes. Similarly, there has been no way to change the propulsion assembly for the different uses. As an example, during downstream sailing using lower level power sources will allow sustaining longer sailing duration. When propelling upstream you can use higher level of power source assembly attain more force. Typically the hull of the average unmanned marine surface vehicle is fixed, thus making it less versatile. During propulsion, a long and slim body has better efficiency of motion, yet lacks the convenience for quick and easy loading into or onto a compact car for transport. Conversely, a vehicle designed with a shorter body is useful for carrying and loading, yet lacks stability while sailing. Thus, to improve upon the above dilemmas in carrying and loading, while retaining the qualities of an ideal marine surface vehicle, the inventor has come up with the following changes, through search and trial and error testing.

SUMMARY OF THE INVENTION

An object of the present invention is to provide a marine surface vehicle which allows users to choose different control tools to suit the required uses and, at the same time, to have the option of choosing the desired propulsion section to obtain optimal combination of mobility and practicality.

Another object of the present invention is to provide a modularized unmanned marine surface vehicle, which can keep the actual size and weight optimal for both carrying and loading.

The other object of this present invention is to provide a modularized unmanned marine surface vehicle, which can keep the total cost minimal. The proposed outlines of the invention include the added benefit of being able to have several possible assemblies, or options. So while the uses can be numerous, the overall cost is kept reasonable.

BRIEF DESCRIPTION OF THE DRAWINGS

The other design features, specifications and implementations of the invention can be more fully understood by referring to the following descriptions and accompanying drawings. They are as follows.

DETAILED DESCRIPTION OF THE PREFERRED EMBODIMENT

Figure 1:
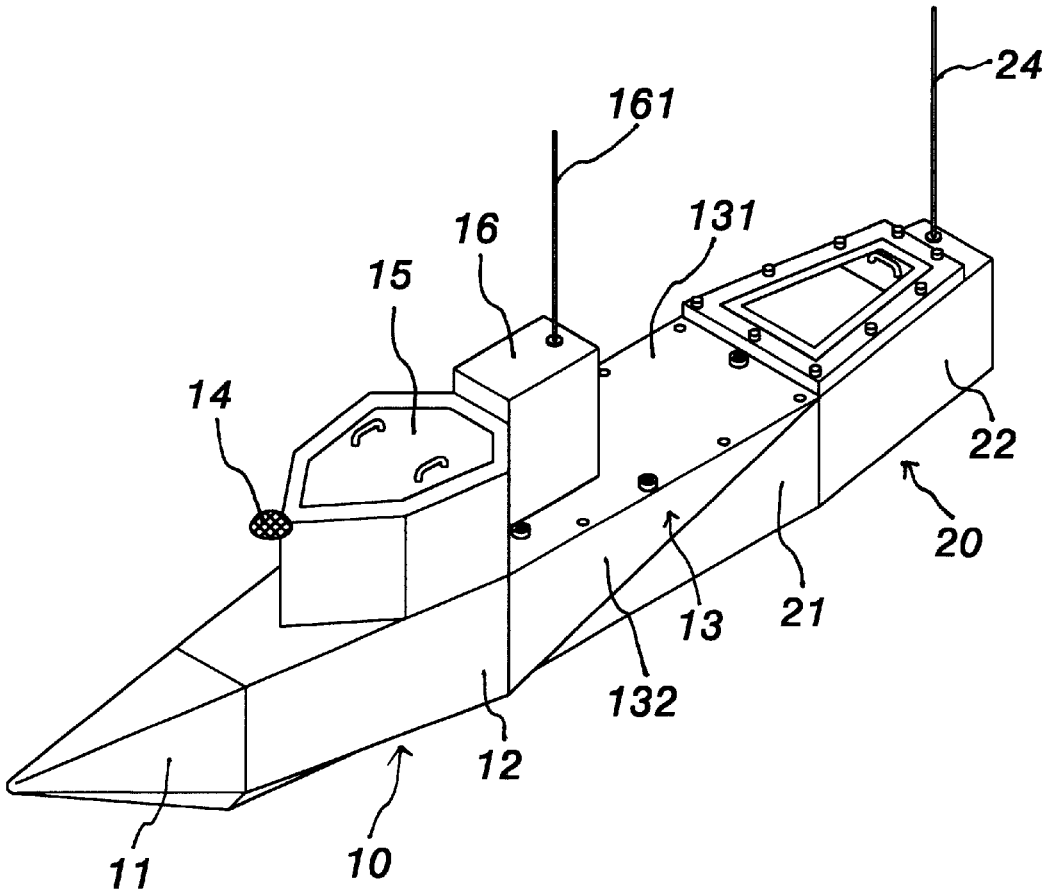
FIG. 1 is an overview of entire vehicle.
Figure 2:
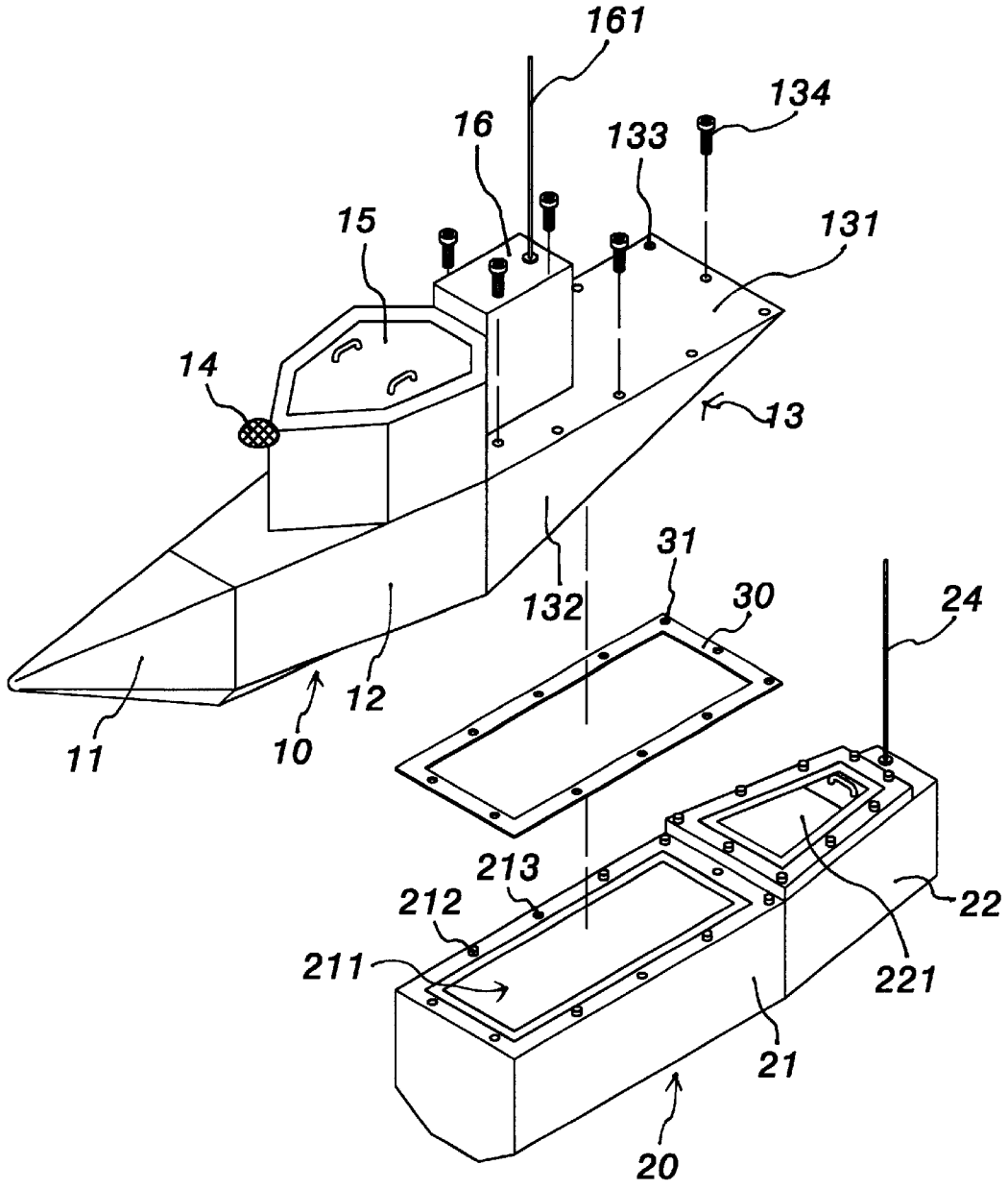
FIG. 2 is a partial assembly view of vehicle.
Figure 3:
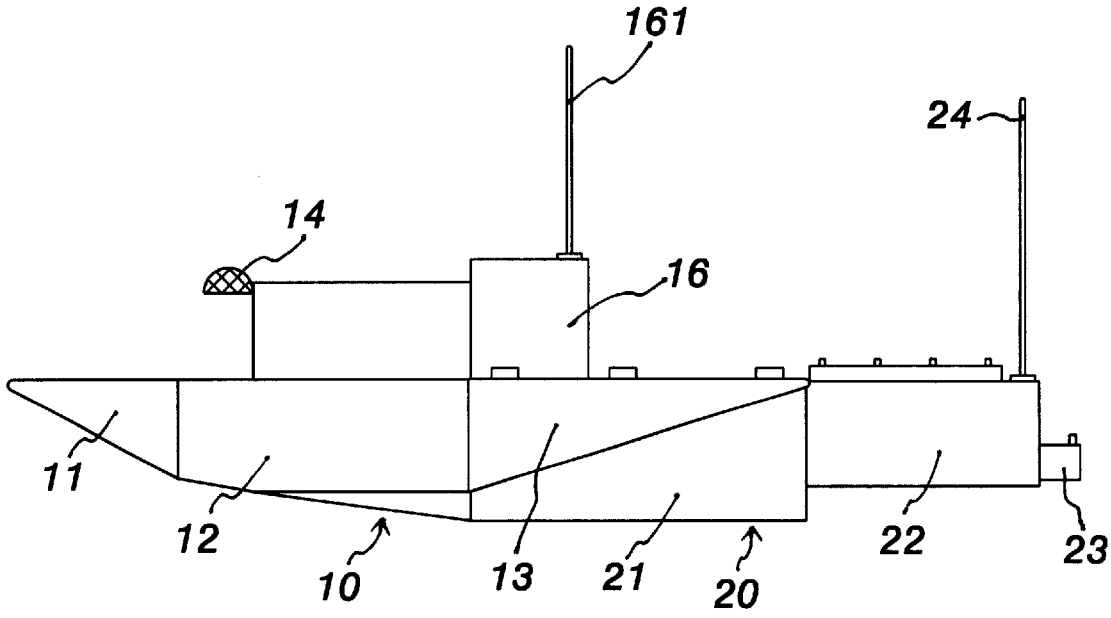
FIG. 3 is a side view of vehicle.

Referring to FIGS. 1, 2 and 3, the marine surface vehicle with its customized options is composed of a control section

10 and a propulsion section 20. The control section 10 is composed of a bow section 11 and control cabin 12 with a conjunction module 13. The upper portion of the control cabin 12 is equipped with a GPS (Global Positioning System) antenna/receiver 14 and a front cabin cover 15 that acts as a cover for the cabin. The conjunction module 13 is composed of the cover panel 131 and triangle wing panels 132. The triangle wing panels 132 are extended downward from the both sides of the cover panel 131 which is extended from the control cabin 12. There are several available screw holes 133, on the edges and on the top of the cover panel 131 equipped with a modem 16 connecting with a modem antenna 161. The propulsion section 20 is equipped with an energy cabin 21 and a power plant cabin 22. The energy cabin 21 has an opening 211 and there are numbers of short bars 212 and screw holes 213 on the edges of the opening. The opening space of the power plant cabin 22 is equipped with a rear cabin cover 221. The power source assembly 23 which can house a propeller or water jet is located in the power plant cabin 22 and its tail, trails out of the rear of the power plant cabin 22 to aid in the propulsion. The energy cabin 21 can be loaded with a battery set and/or gasoline or diesel fuel tank. The power plant cabin 22 can be equipped with a propeller, a water jet or a turbine jet propeller of high power or low power as the power source assembly. The rear of the power plant cabin 22 is equipped with a remote-control antenna 24. A control module and a probing module are located in the previously mentioned control cabin 12. The control module is connected with a communication module, which is composed of the GPS antenna/receiver 14, the modem 16, and the remote-control antenna 24 to control and adjust the direction via the information obtained through the probing module. The probing module's possible tasks include obtaining information on the depth of water, water quality assessment, temperature measurement, current analysis, and even underwater photography. The probing instrument could be located and maneuvered from either the control section 10 or the outside of the propulsion section 20 to complete the desired task. The gasket holes 31 correspond to the short bar 212 and screw holes 213 located on the energy cabin 21. The gasket 30 is laid on the top of the energy cabin 21 which is used as the cover panel 131 of the conjunction module 13. Both of the wing panels 132 wrap around the energy cabin 21. Through a number of bolts 134, the cover panel 131 can be fitted on top of the power plant cabin 22. By using a gasket 30, the cover panel 131 and the energy cabin 21 could be fully waterproofed. The bow section 11 can be made by polyurethane foaming material. The empty area within the control section 10 and the propulsion section 20 can be filled up with polyurethane foaming material to maintain, or adjust the level of buoyancy of the vehicle. The lower part on the both sides of the control section 10 could be equipped with fins to improve vehicle stability while sailing. The control section 10 and the propulsion section 20 in the proposed marine surface vehicle are capable of being broken down into two separate parts to shorten its length, thus making it convenient for carrying and loading. There can be a range of various kinds of probing modules to install in the control section, and as well there are different kinds of power source assemblies to install depending on the purposes and conditions. Accordingly the design allows for three kinds of control sections, and three options for power selection. The results are therefore nine possible combinations to achieve many desired functions of the vehicle. Nine vehicles in one, with the owner to choose the specific purpose for each mission. Modifications or variations may be easily made without departing from the spirit or technical base of this invention, which have been described in the above sections.

What is claimed is:

1. A modular, unmanned marine surface vehicle comprising:

a) a propulsion section including a power plant cabin containing a power source for propelling the marine surface vehicle, and an energy cabin including opposite sides and an upper opening, the energy cabin configured to house an energy source for the power source; and, b) a control section removably attached to the propulsion section and including a bow section, a control cabin and a conjunction module, the conjunction module having a cover panel removably attached to the energy cabin so as to cover the upper opening of the energy cabin and to removably attach the control section to the propulsion section, the conjunction module further having wing panels extending from the cover panel so as to be located on the opposite sides of the energy cabin.

2. The modular unmanned marine surface vehicle of claim 1 further comprising a plurality of bars extending from the energy cabin adjacent to the upper opening.

3. The modular unmanned marine surface vehicle of claim 1 further comprising a gasket located between the cover panel and the energy cabin adjacent to the upper opening.

4. The modular unmanned marine surface vehicle of claim 1 further comprising a global positioning system (GPS) antenna/receiver mounted on the control section.

5. The modular, unmanned marine surface vehicle of claim 1 further comprising a modem having a remote-control antenna, the modem being mounted on the control section.

6. The modular unmanned marine surface vehicle of claim 1 further comprising a rear cabin cover attached to the power plant cabin.

* * * * *